US007073750B1

(12) United States Patent
Choi

(10) Patent No.: US 7,073,750 B1
(45) Date of Patent: Jul. 11, 2006

(54) PROPULSION SYSTEM FOR MODEL AIRPLANE

(75) Inventor: Kei Fung Choi, Causeway Bay (HK)

(73) Assignee: Silverlit Toys Manufactory LTD, Hong Kong (CN)

( * ) Notice: Subject to any disclaimer, the term of this patent is extended or adjusted under 35 U.S.C. 154(b) by 0 days.

(21) Appl. No.: 11/071,616

(22) Filed: Mar. 3, 2005

Related U.S. Application Data

(60) Provisional application No. 60/649,981, filed on Feb. 4, 2005.

(51) Int. Cl.
*B64D 27/02* (2006.01)
*A63H 27/00* (2006.01)

(52) U.S. Cl. ..... 244/13; 244/54; 244/55; 244/190; 446/57

(58) Field of Classification Search ..... 244/13, 244/51, 52, 54, 55, 189, 190, 87; 446/57, 446/454, 34, 49, 50, 61, 62, 63, 66, 67, 68
See application file for complete search history.

(56) References Cited

U.S. PATENT DOCUMENTS 1,431,244 A * 10/1922 Mendel ..... 244/55
1,465,973 A * 8/1923 Curtiss ..... 244/87
1,782,013 A * 11/1930 Rohrbach ..... 244/55
1,824,325 A * 9/1931 Breguet ..... 244/55
2,402,311 A * 6/1946 Bissett ..... 244/13
3,289,975 A * 12/1966 Hall ..... 244/12.5
3,937,424 A 2/1976 Meier et al.
3,940,882 A 3/1976 Mabuchi
4,203,250 A 5/1980 Garofalo
5,087,000 A * 2/1992 Suto ..... 244/189
5,364,298 A 11/1994 Crisci et al.
5,520,355 A 5/1996 Jones
5,573,204 A 11/1996 Barker et al.
5,645,250 A 7/1997 Gevers
6,428,380 B1 8/2002 Murphy
6,520,823 B1 * 2/2003 Tian et al. ..... 446/57
2003/0197092 A1 * 10/2003 Tian et al. ..... 244/51
2004/0075028 A1 4/2004 Wang
2004/0195438 A1 10/2004 Chamberlain

* cited by examiner

*Primary Examiner*—Galen Barefoot
(74) *Attorney, Agent, or Firm*—Greenberg Traurig LLP; Charles Berman, Esq.; Bruce T. Neel, Esq.

(57) ABSTRACT

An improved structure and method for powering the flight of a model airplane by positioning the motors and propellers on the back side of the top wings of an airplane using a single or double-deck wing design so that the propellers and motors of the airplane are better protected from damage in the event of a crash. The fuselage of the airplane is formed of a deformable material such as a foam to aid in crash resistance.

32 Claims, 6 Drawing Sheets

FIG. 8
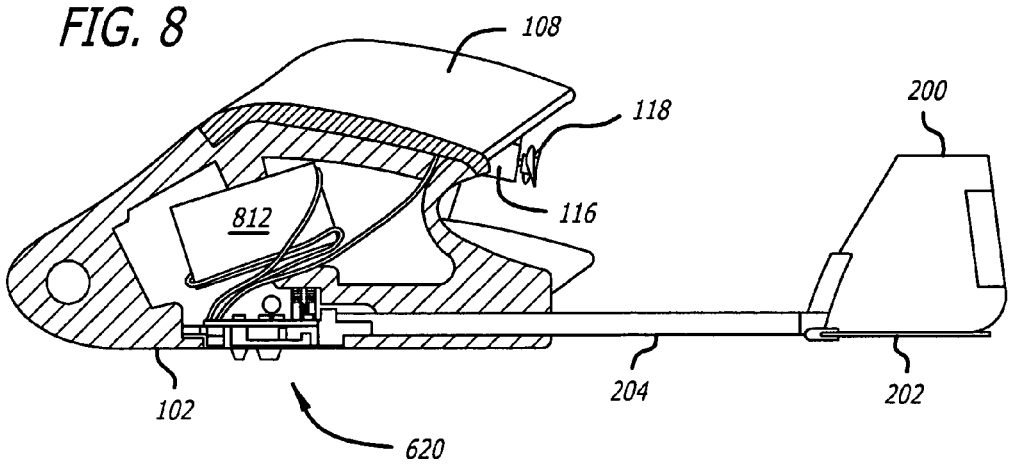
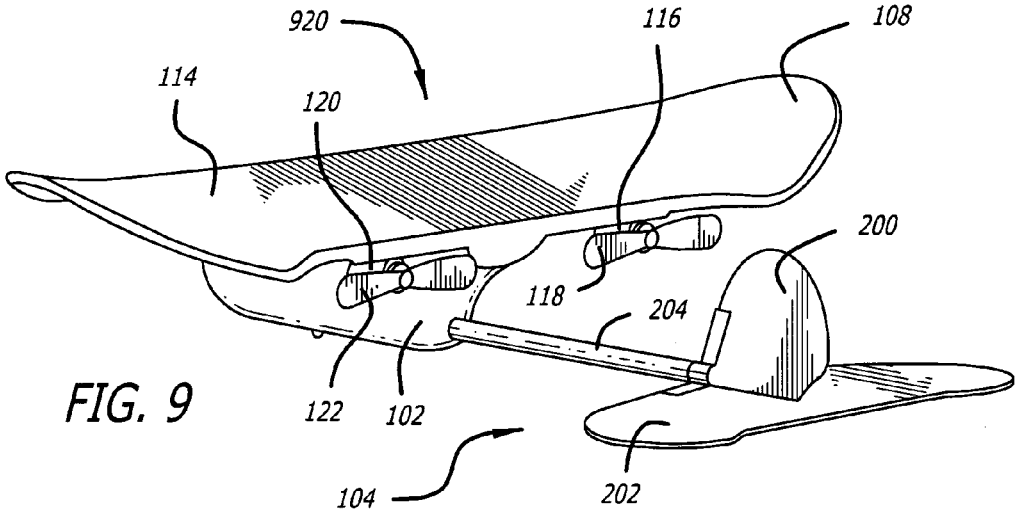
FIG. 9
FIG. 10
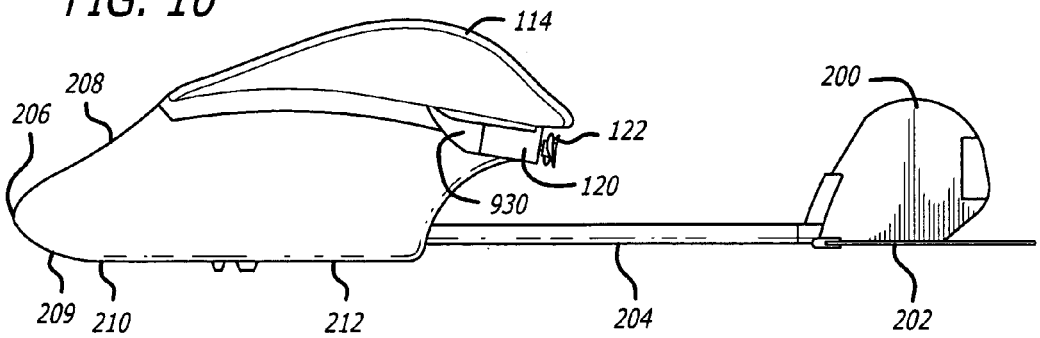

PROPULSION SYSTEM FOR MODEL AIRPLANE

RELATED APPLICATION

This application is a non-provisional application claiming benefit under 35 U.S.C. sec. 119(e) of U.S. Provisional Application Ser. No. 60/649,981, filed Feb. 4, 2005 (titled PROPULSION SYSTEM FOR MODEL AIRPLANE by Kei Fung Choi), which is incorporated by reference herein.

COPYRIGHT PROTECTION

A portion of the disclosure of this patent document contains material that is subject to copyright protection. The copyright owner has no objection to the facsimile reproduction by anyone of the patent document or the patent disclosure in its entirety and in the form as it appears in documents published or released by the U.S. Patent and Trademark Office from its patent file or records, but otherwise reserves all copyright rights whatsoever.

BACKGROUND

The present disclosure relates generally to flying model airplane structures, and, more particularly, to a propulsion system for a flying model airplane.

Flying model airplanes, often also referred to as toy flying airplanes, have enjoyed a long-lasting and extensive popularity among children and adults for many years. The continuous development of model airplanes has included the development of small scale self-powered toy or model airplanes intended for amusement and entertainment. In addition, remotely controlled aircraft using either a controlling tether or radio signal transmission link has further improved the realism and enjoyment of toy and model airplanes.

Model airplanes capable of flight typically use one or more small internal combustion engines or electric motors driving one or more propellers. These motors and propellers are mounted on the front of the wings of the airplane. Because model airplanes often crash into the earth or another obstacle, this frontal placement of the propellers often leads to damage of the propellers and/or motors when the plane crashes.

In more detail, most available radio control (RC) toy planes typically have one propeller on the plane nose with two actuators, such as servo motors or solenoids for elevator and rudder control. This configuration is expensive, uses complicated hardware, and is heavy. Other available RC toy planes may have two propellers located on the leading edge of the wing without any elevator and rudder control. In both of these designs, the propellers and/or motor shafts can be very easily distorted or even broken while landing or during a crash. This will reduce the later flying performance and even product life. Also, for indoor play, the use of a high speed propeller on the front of the plane is hazardous. Children may be injured as a result.

Accordingly, it would be desirable to have an improved structure for an flying model airplane that is more resistant to damage from a crash and/or from regular usage such as landing.

BRIEF DESCRIPTION OF THE DRAWINGS

For a more complete understanding of the present disclosure, reference is now made to the following figures, wherein like reference numbers refer to similar items throughout the figures:

FIG. 8 is a cross-sectional view of the airplane of FIG. 1;

FIG. 9 is a rear perspective view of an airplane having only a single wing on each side of the fuselage according to an another exemplary embodiment of the present disclosure;

FIG. 10 is a side view of the airplane of FIG. 9;

The exemplification set out herein illustrates particular embodiments, and such exemplification is not intended to be construed as limiting in any manner.

DETAILED DESCRIPTION

The following description and the drawings illustrate specific embodiments sufficiently to enable those skilled in the art to practice the systems and methods described herein. Other embodiments may incorporate structural, method, and other changes. Examples merely typify possible variations.

The present disclosure presents an improved structure and method for powering the flight of a model airplane so that the propellers and motors of the airplane are better protected from damage in the event of a crash.

Figure 1:
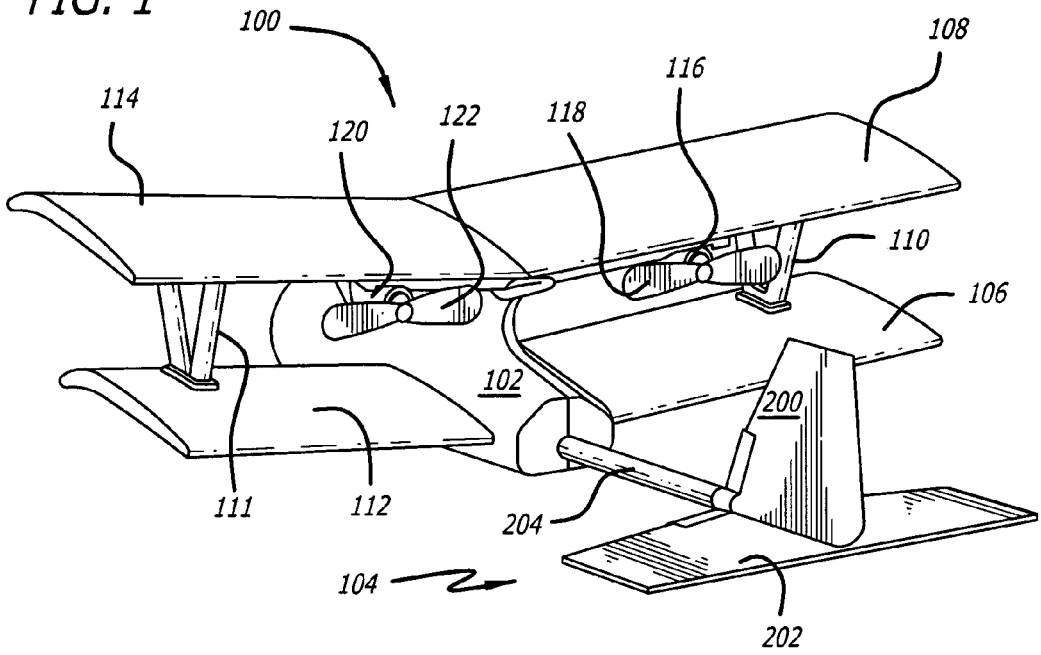
FIG. 1 illustrates a rear perspective view of a flying model airplane according to an exemplary embodiment of the present disclosure.

FIG. 1 illustrates a rear perspective view of a flying model airplane 100. Flying model airplane 100 has a fuselage 102, and a wing 108 and a wing 114 attached to and extending from opposite sides of the fuselage 102. A first propulsion unit, having a motor 116 and a propeller 118 rotated by the motor 116, is mounted at the back of the wing 108. A second propulsion unit, having a motor 120 and a propeller 122 rotated by the motor 120, is mounted at the back of the wing 114. A tail 104 is connected to the fuselage 102.

The mounting of the motors and propellers at the trailing edge of the wings typically assists in minimizing damage to the motors, drive shaft, and/or propellers during a crash or hard landing or other hard usage. Also, the hazard to children from front-mounted propellers is reduced.

Airplane 100 further includes a wing 106 disposed under the wing 108 and a wing 112 disposed under the wing 114. Preferably, airplane 100 has a fuselage 102 formed of a break-resistant material such as, for example, a polyfoam or other soft and/or deformable materials so that a crash or hard landing by airplane 100 does not cause significant structural damage. The wings and tail of airplane 100 are also preferably formed of such a break-resistant material.

The wings 106 and 108 are connected, for example, by a first strut 110, and the wings 112 and 114 are connected, for example, by a second strut 111. The first propulsion unit may be mounted, for example, between the fuselage 102 and the first strut 110, and the second propulsion unit may be mounted, for example, between the fuselage 102 and the second strut 111.

Airplane 100 may further include a rudder 200 and an elevator 202 each coupled to the fuselage, for example, by a long, thin rod or other slender member 204. It should be noted that the vertical distance between the wings 108 and 106 may be, for example, about equal to or greater than the height of the rudder 200. Also, the width of the elevator 202 is, for example, less than twice the height of the rudder 200. In addition, the wings 106 and 112 may be, for example, disposed in about the same geometric plane as the elevator 202. Also, the lower wings 106 and 112 in a double-deck wing design are able to act as a linear bumper to protect the propellers from touching the floor or ground while landing.

Figure 2:
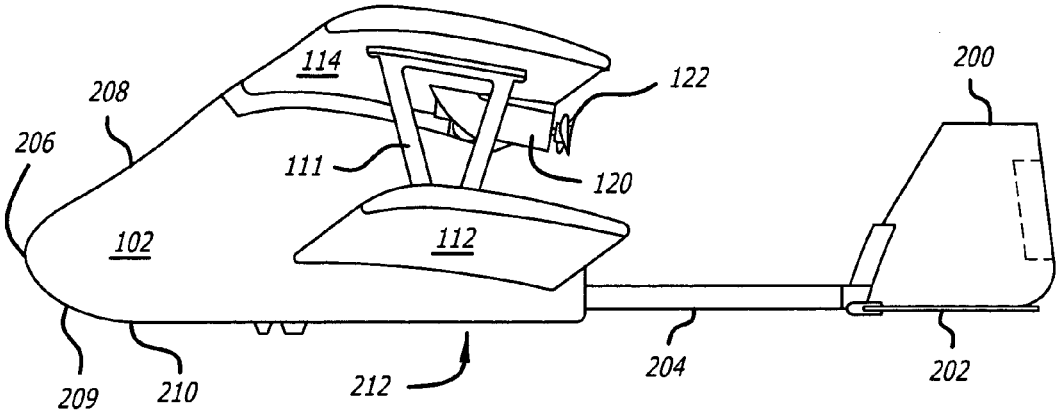
FIG. 2 illustrates a side view of the airplane of FIG. 1.

FIG. 2 illustrates a side view of airplane 100. In this embodiment, the motors 116 and 120 are each mounted underneath the wings 108 and 114. Other mounting positions may be used, such as the top and back of the wings 108 and 114. The propellers may be mounted to the motor directly without the use of gearing. Also, in certain other embodiments, the motors could be mounted to the lower wings 106 and 112.

Airplane 100 may have a rounded nose 206 that tapers gradually away from a leading point on both the bottom and top of the nose, and the fuselage 102 may protrude forward in front of the first and second wings 108 and 114. Note here that the top 208 of the fuselage substantially continuously rises from the nose 206 to about the front edge of the first and second wings 108 and 114, and the bottom 209 of the fuselage 102 substantially continuously falls from the nose 206 to a point 210 in front of the wings 106 and 112. In addition, in this embodiment, the bottom 212 of the fuselage 102 is substantially flat from the point 210 back to the lower rearward portion of the fuselage 102. Also, bottom 212 is in about the same geometric plane as elevator 202, which may assist with resistance to minor crash landings on the ground.

The aspect ratio used in each of the wings is preferably a large aspect ratio. This typically assists airplane 100 in generating more lift in flight. The usage of a larger aspect ratio with a double-deck wing design as illustrated in FIG. 1 should typically provide enough up-thrust power for the flight of airplane 100 so that, for example, airplane 100 may fly at a low flight speed (e.g., less than 3 m/s).

It should be noted that the axis of rotation of each of the first and second propellers may be angled in a downward direction. By increasing the throttle, airplane 100 typically will tend to fly upward rather than flying much faster.

Also, the distance between the first and second propellers and the tail of the airplane is preferably sufficiently short that the air flow to the elevator 202 will generate some downward force on the tail 104. For example, this distance may be less than about 120 mm, and as a specific example may be about 85 mm. As a result of this air flow and shorter distance, torque may be applied on the tail such that the nose of airplane 100 points upward somewhat, which helps airplane 100 to fly upward.

Figure 3:
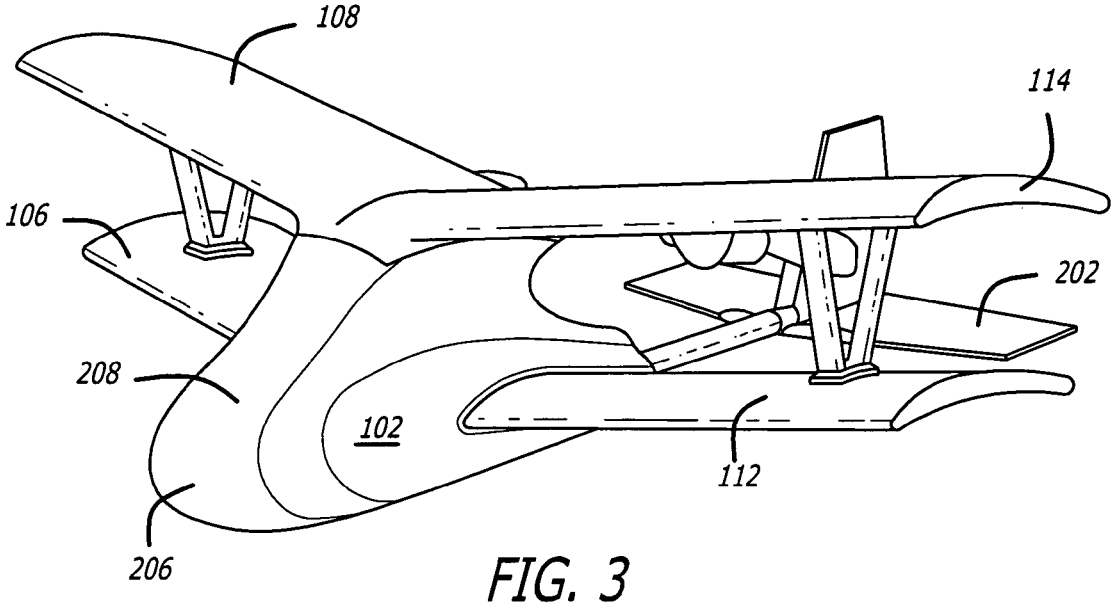
FIG. 3 illustrates a front perspective view of the airplane of FIG. 1.

FIG. 3 illustrates a front perspective view of airplane 100. Fuselage 102 generally widens moving from the upper portions of fuselage 102 near wings 108 and 114 to the lower portions of fuselage 102 near wings 106 and 112.

Figure 4:
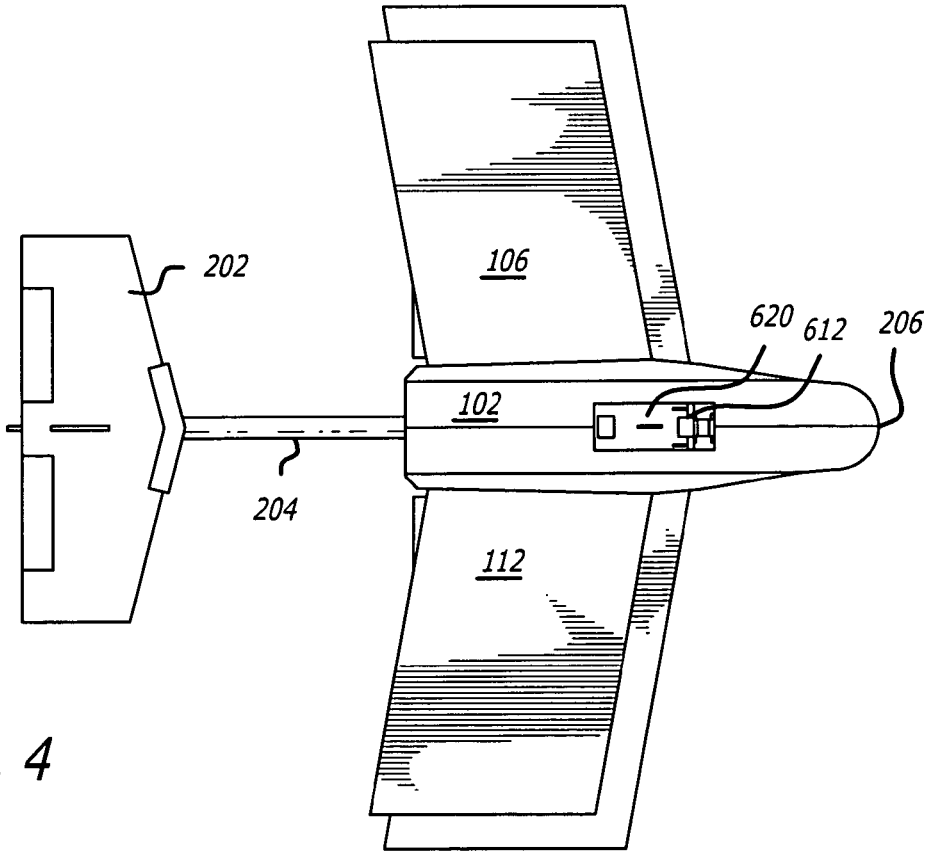
FIG. 4 illustrates a bottom view of the airplane of FIG. 1.

FIG. 4 illustrates a bottom view of airplane 100. A receiver unit 620 may be mounted in the bottom of airplane 100 to receive control signals (e.g., from a ground-based transmitter unit as discussed below) for use in controlling the flight of airplane 100. A charging socket 612 of receiver unit 620 may be used to couple a rechargeable battery mounted in airplane 100 to an external charger (e.g., in the transmitter unit discussed below).

Figure 5:
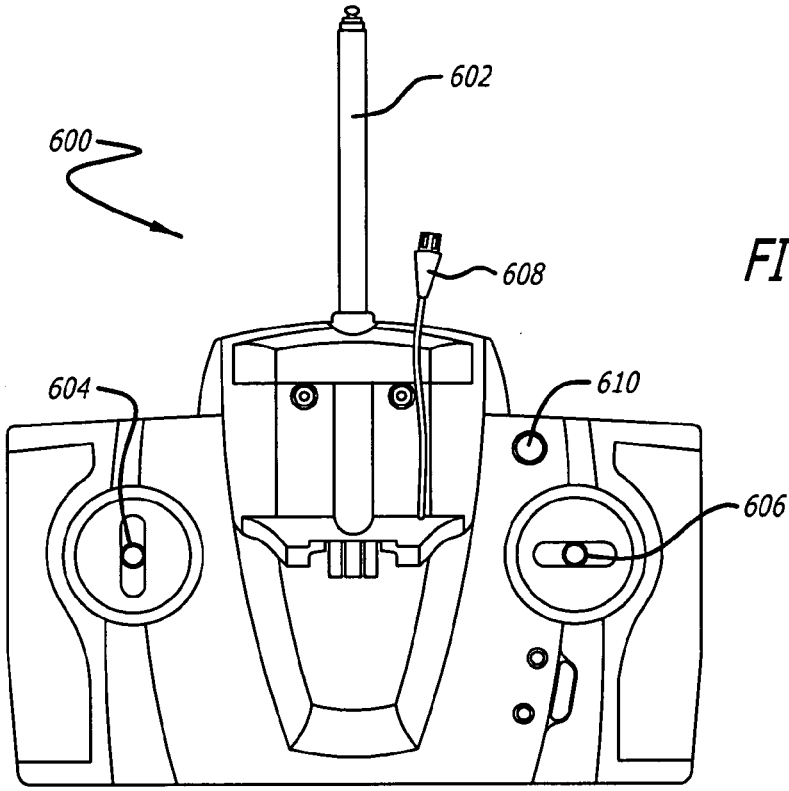
FIG. 5 illustrates a top view of a transmitter Unit that may be used in controlling the flight of the airplane of FIG. 1.

FIG. 5 illustrates a top view of a transmitter unit 600 for use in controlling the flight of airplane 100. Transmitter unit 600 has an antenna 602 that may be used to communicate with receiver unit 620. Transmitter unit 600 has a throttle control stick 604 to control power to motors 116 and 120, and has a left/right control stick 606 for directing airplane 100 to turn left or right. The throttle control stick 604 may implement throttle control, for example, divided into seven steps with digital proportional control. Airplane 100 may be flown upwards by increasing the throttle and downwards by decreasing the throttle. The left/right control stick 606 may, for example, implement left and right direction control by varying the relative speeds of the left and right propellers as discussed below.

Steering or alignment trimmer 610 may be used to establish the straight flying of airplane 100 when the directional control lever is not being pushed. Trimmer 610 may be adjusted until the left and right propellers are providing about the same output power when directional control is not being activated by lever 606.

Transmitter unit 600 may also include a built-in charger that can fully charge a rechargeable battery in airplane 100. Transmitter unit 600 may include a power "on" indicator (e.g., an LED) and a charging status indicator (e.g., another LED). Transmitter unit 600 may use, for example, time-multiplexing programming technology in which up to, for example, three planes with the same radio frequency, such as 27.145 MHz, may be operated at the same time.

Receiver unit 620 may be mounted in the fuselage of airplane 100 as discussed above. Charging socket 612 of receiver unit 620 may be used to couple a rechargeable battery mounted in airplane 100 to a charger disposed in transmitter unit 600. Transmitter unit 600 may include a plug or other charging means 608 for coupling to charging socket 612 for charging of the battery in airplane 100.

Figure 6:
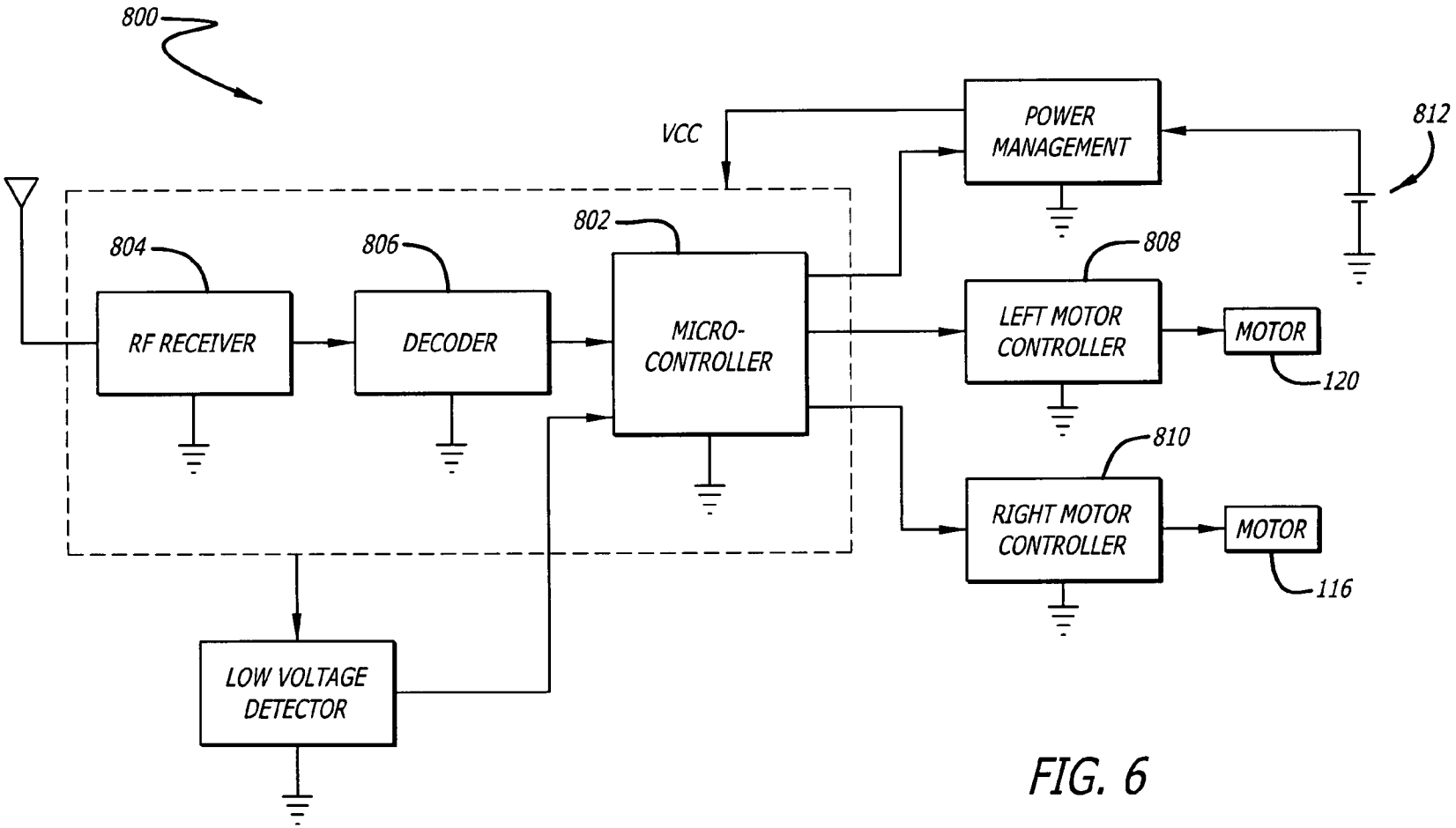
FIG. 6 is a block diagram of a control system for controlling the airplane of FIG. 1 by radio control.

FIG. 6 is a block diagram of a control system 800 for controlling airplane 100 by radio control. Control system 800 may be included as part of receiver unit 620 in airplane 100. Control system 800 includes a processor 802 (e.g., a microcontroller) coupled to control the first and second motors 116 and 120. A radio frequency (RF) signal may be demodulated by an RF receiver 804 and decoded by decoder 806 and processor 802 in order to control the speed of the motors using controllers 808 and 810.

The processor may be programmed to control a rotational speed difference between the first and second propellers 118 and 122 to assist the airplane in making a turn. To control the direction of flight of airplane 100, the left propeller, for example, should spin faster than the right propeller to make a right turn, and vice versa for a left turn.

As another example, to control the turning of the plane to the left, the up-thrust on the right wing may be increased (i.e., the right propeller may be controlled to spin faster than the left propeller). As a result, the right side will be a bit higher than the left side and the plane will thus turn left. A similar concept may be applied when the plane is to turn right. In other embodiments, turning may also be controlled further or alternatively using the rudder.

A battery 812 may be mounted in the fuselage 102 and coupled to provide power to operate the RF receiver 804. The battery may be, for example, a lightweight lithium polymer battery. Such a battery may help to maximize the output energy to weight ratio for a small, light airplane.

Airplane 100 may be able to run, for example, about 10 minutes with such a fully-charged battery.

Figure 7:
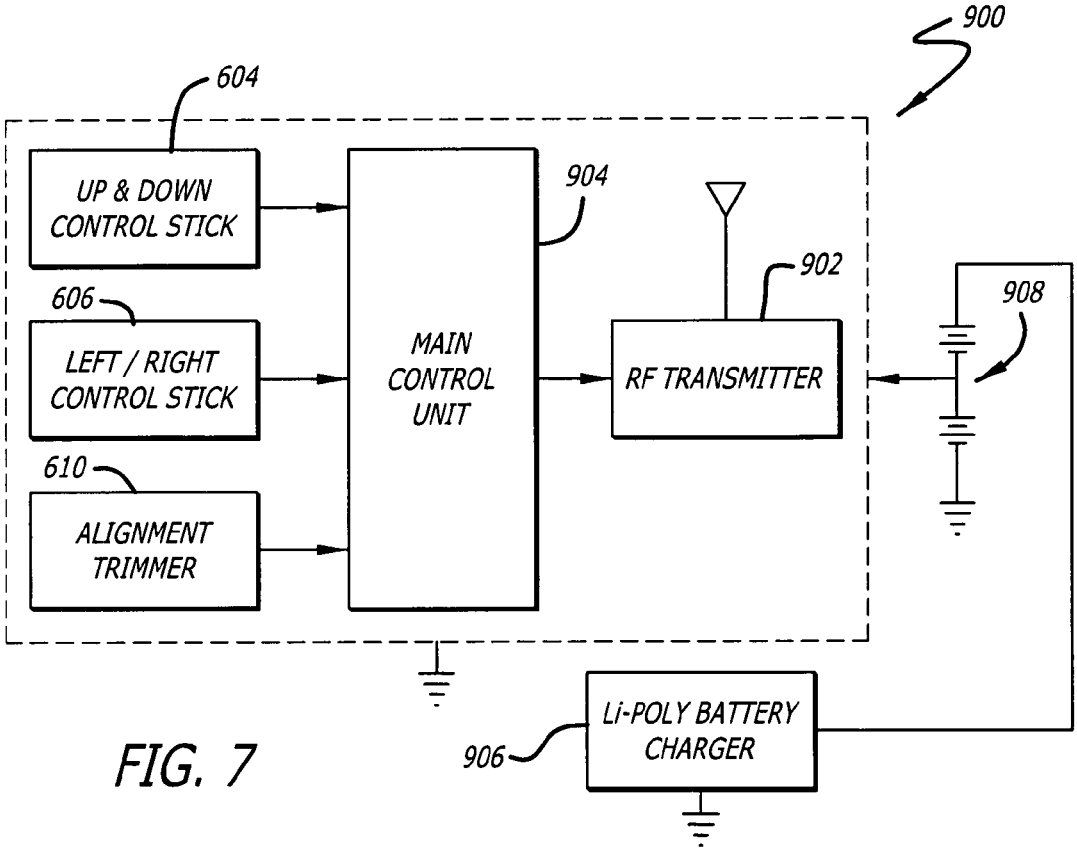
FIG. 7 is a block diagram of a transmitter system to permit a user on the ground to communicate remotely with the control system of FIG. 6.

FIG. 7 is a block diagram of a transmitter system 900 to permit a user on the ground to communicate remotely with control system 800. Transmitter system 900 may be incorporated as part of transmitter unit 600. Transmitter system 900 includes an RF transmitter 902 coupled to left/right control stick 606, throttle control stick 604, and alignment trimmer 610 by a main control unit 904. Charger 906 is coupled to charge a battery 908 for powering RF transmitter 902.

FIG. 8 is a cross-sectional view of airplane 100. Battery 812 is positioned, for example, inside of fuselage 102. Receiver unit 620 is coupled to receive operating power from battery 812.

FIG. 9 is a rear perspective view of an airplane 920 having only a single wing on each side of the fuselage. Airplane 920 may be built and flown similarly as described for airplane 100 above. More specifically, airplane 920 includes wings 108 and 114 that provide a single-deck wing design. Motors 116 and 120 may be similarly mounted and positioned as described for airplane 100 above.

FIG. 10 is a side view of airplane 920. An integral portion 930 of wing 114 extends downwards from the bottom of wing 114 to assist in mounting motor 120. Portion 930 also provides some aerodynamic covering for the front portion of motor 120. Although 930 is shown as integral in FIG. 10, in other embodiments, portion 930 may be implemented as a separately attached component. Also, airplane 100 may use integral portions 930 to mount motors 116 and 120 as just described for airplane 920.

Elevator 202 in airplane 920 may extend well beyond the rear of rudder 200. In other embodiments, elevator 202 may be of a shorter length, for example, as illustrated for airplane 100.

Figure 11:
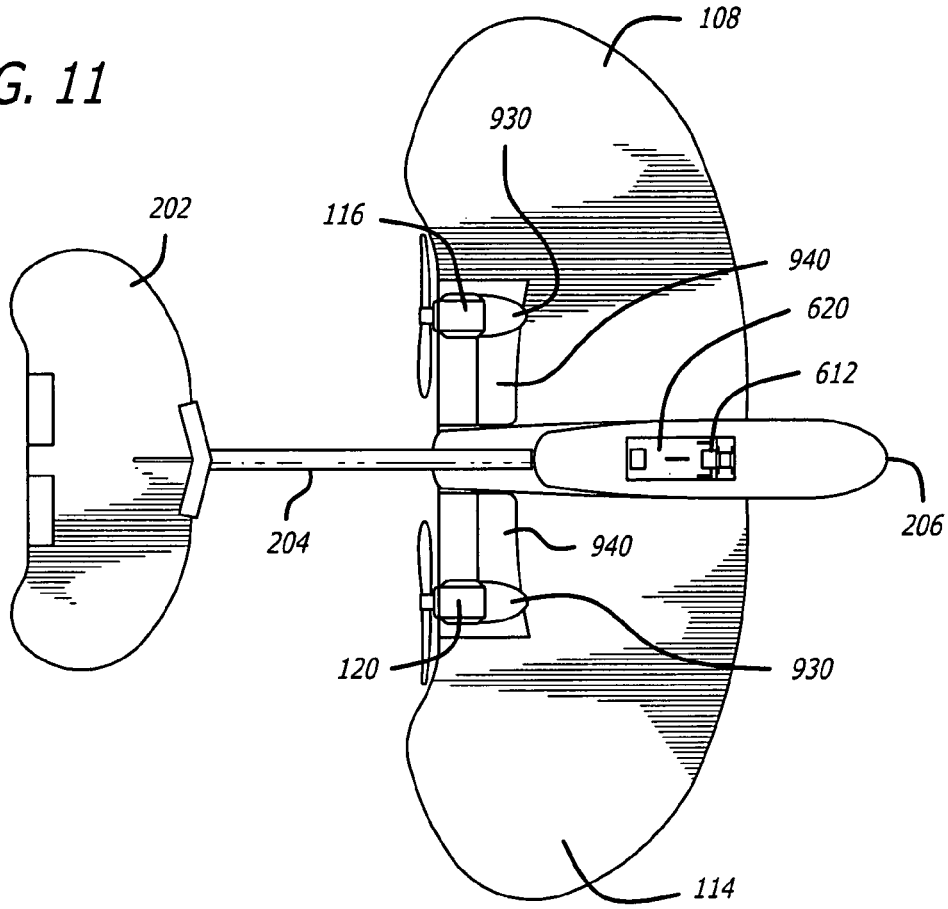
FIG. 11 is a bottom view of the airplane of FIG. 9.

FIG. 11 is a bottom view of airplane 920. Integral portions 930 are shown disposed in front of and for aiding in mounting motors 116 and 120 as discussed above. Also, reinforced regions 940 of wings 108 and 114 may be used to provide increased rigidity and/or strength in the regions of wings 108 and 114 to which motors 116 and 120 are mounted.

Figure 12:
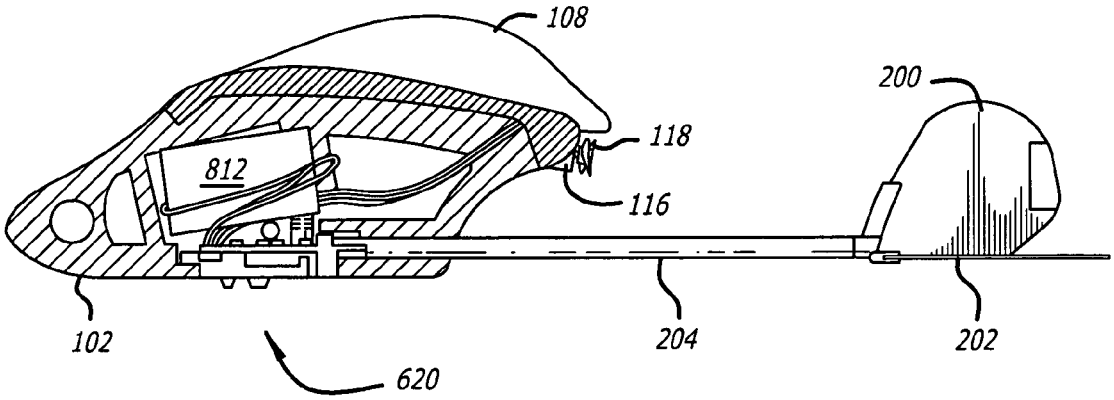
FIG. 12 is a cross-sectional view of the airplane of FIG. 9.

FIG. 12 is a cross-sectional view of airplane 920. A battery 812 may be disposed in fuselage 102 similarly as discussed above.

Airplane 100 or 920 are typically light-weight airplanes designed for immediate re-use and flight after one or more minor crashes into the ground or other obstacles (i.e., airplane 100 and 920 are somewhat crash-resistant). It is expected that such minor crashes will not prevent the continued flying enjoyment of a user of airplane 100 or 920. The propulsion system and placement as described above aids in enabling this re-use by helping to avoid catastrophic failures of the propellers or other features of the airplane that might be damaged by the front-mounted placement as in prior model planes. The size of airplane 100 or 920 may be, for example, less than 12 inches long and 10 inches wide, and the weight of airplane 100 including a rechargeable battery may be, for example, less than about 20 g.

It should be noted that the present propulsion structure and method may also be used on airplanes having three wings or more on each side. Also, infrared or programmable control may be used as alternatives to radio control. In addition, lithium ion batteries, high-density capacitors, and other power sources may be used on airplane 100.

By the foregoing disclosure, an improved structure and method for propelling a flying model airplane have been described. The foregoing description of specific embodiments reveals the general nature of the disclosure sufficiently that others can modify and/or adapt it for various applications without departing from the generic concept. Therefore, such adaptations and modifications are within the meaning and range of equivalents of the disclosed embodiments. The phraseology or terminology employed herein is for the purpose of description and not of limitation.

What is claimed is:

1. A flying model airplane comprising:

a fuselage having a first wing and a second wing attached to and extending from opposite sides of the fuselage;

a first propulsion unit, having a first motor and a first propeller rotated by the first motor, mounted at the back of the first wing;

a second propulsion unit, having a second motor and a second propeller rotated by the second motor, mounted at the back of the second wing;

a tail, comprising an elevator, connected to the fuselage; and wherein the axis of rotation of each of the first and second propellers is angled in a fixed downward direction, and the distance between the first and second propellers and the tail is sufficiently short that the air flow from the propellers to the elevator will generate some downward force on the tail.

2. The airplane of claim 1 further comprising a third wing disposed under the first wing and a fourth wing disposed under the second wing.

3. The airplane of claim 1 wherein the fuselage is formed of a deformable material.

4. The airplane of claim 3 wherein the material is a polyfoam.

5. The airplane of claim 1 wherein the fuselage has a rounded nose that tapers gradually away from a leading point on both the bottom and top of the nose.

6. The airplane of claim 2 wherein the first and third wings are connected by a first strut, and the second and fourth wings are connected by a second strut, and wherein the first propulsion unit is mounted between the fuselage and the first strut, and the second propulsion unit is mounted between the fuselage and the second strut.

7. The airplane of claim 6 wherein the first and third wings each has a large aspect ratio.

8. The airplane of claim 1 wherein the tail further comprises a rudder, and the tail is coupled to the fuselage by a long, thin rod.

9. The airplane of claim 2 further comprising a fifth wing and a sixth wing disposed on opposite sides of the fuselage.

10. The airplane of claim 8 wherein the distance between the first and third wings is about equal to or greater than the height of the rudder.

11. The airplane of claim 10 wherein the width of the elevator is less than twice the height of the rudder.

12. The airplane of claim 1 wherein the first motor and the second motor are each mounted underneath the first and second wing, respectively.

13. The airplane of claim 2 wherein the third and fourth wings are disposed in about the same horizontal plane as the elevator.

14. The airplane of claim 1 wherein the fuselage has a nose and the top of the fuselage substantially continuously rises from the nose to about the front edge of the first and second wings.

15. The airplane of claim 14 wherein the bottom of the fuselage substantially continuously falls from the nose to a point in front of the third and fourth wings.

16. The airplane of claim 15 wherein the bottom of the fuselage is substantially flat from the point in front of the third and fourth wings back to the rear of the fuselage.

17. The airplane of claim 1 wherein the bottom of the fuselage is substantially flat and the elevator is in about the same geometric plane as the elevator.

18. The airplane of claim 2 wherein the combined wing area of the first and second wings is greater than the combined wing area of the third and fourth wings.

19. The airplane of claim 1 wherein the distance is less than about 120 mm.

20. The airplane of claim 1 wherein the distance is about 85 mm.

21. The airplane of claim 1 further comprising a processor coupled to control the first and second motors.

22. The airplane of claim 21 wherein the processor is operable to control a rotational speed difference between the first and second propellers to assist the airplane in making a turn.

23. The airplane of claim 21 further comprising a radio receiver coupled to the processor.

24. The airplane of claim 23 further comprising a battery mounted in the fuselage and coupled to provide power to operate the radio receiver.

25. A flying model airplane comprising:

a fuselage having a first wing and a second wing attached to and extending from opposite sides of the fuselage;

a first propulsion unit, having a first motor and a first propeller rotated by the first motor, mounted at the back of the first wing;

a second propulsion unit, having a second motor and a second propeller rotated by the second motor, mounted at the back of the second wing;

wherein the fuselage is formed of a deformable material;

wherein the axis of rotation of each of the first and second propellers is angled in a downward direction; and wherein the bottom of the fuselage provides a landing surface without wheels.

26. The airplane of claim 25 wherein the first wing comprises an integral portion that extends downward in front of the first motor and the second wing comprises an integral portion that extends downward in front of the second motor.

27. A flying model airplane comprising:

a fuselage having a first wing and a second wing, for providing the main wing of the airplane, attached to and extending from opposite sides of the fuselage;

a first propulsion unit, having a first motor and a first propeller rotated by the first motor, mounted at the back of the first wing;

a second propulsion unit, having a second motor and a second propeller rotated by the second motor, mounted at the back of the second wing;

a processor, coupled to accept inputs from a radio receiver, electrically coupled to control the first and second motors in response to control signals for directing the airplane's flight received by the radio receiver;

wherein the axis of rotation of each of the first and second propellers is angled in a fixed downward direction;

wherein the processor is operable to control a rotational speed difference between the first and second propellers to assist the airplane in making a turn; and wherein the airplane is operable to be controlled in upwards and downwards flight without the use of elevator control.

28. The airplane of claim 27 wherein the fuselage is formed of a deformable material.

29. The airplane of claim 27 further comprising an elevator, wherein the bottom of the fuselage is in about the same geometric plane as the elevator.

30. The airplane of claim 27 wherein the first motor is mounted underneath the first wing and the second motor is mounted underneath the second wing.

31. The airplane of claim 27 wherein the airplane has a tail and the distance between the first and second propellers and the tail is less than about 120 mm.

32. The airplane of claim 27 wherein the first and second propellers are respectively mounted to the first and second motors directly without the use of gearing.

* * * * *